US006016805A

United States Patent [19]

Burns et al.

[11] Patent Number: 6,016,805

[45] Date of Patent: Jan. 25, 2000

[54] FACE SEAL FOR RESPIRATOR

[75] Inventors: James A. Burns, Lake Elmo; Gerald M. Brostrom, Burnsville, both of Minn.

[73] Assignee: 3M Innovative Properties Company, St. Paul, Minn.

[21] Appl. No.: 09/037,631

[22] Filed: Mar. 10, 1998

[51] Int. Cl.[7] ..... A62B 18/08

[52] U.S. Cl. ..... 128/206.24; 128/200.28; 128/201.24; 128/206.21; 128/207.11; 128/201.22; 128/201.23; 2/422; 2/442

[58] Field of Search ..... 2/171.3, 410, 422, 2/441, 442, 424; 128/200.28, 201.22, 201.23, 201.24, 201.25, 201.29, 202.19, 202.24, 206.12, 206.16, 204.21, 206.23, 206.24, 201.26, 206.27, 207.11

[56] References Cited

U.S. PATENT DOCUMENTS

| | | | |
|---|---|---|---|
| 577,926 | 3/1897 | Miller | 128/206.24 |
| 3,031,673 | 5/1962 | Korolick | 2/410 |
| 3,562,813 | 2/1971 | Origer | 128/200.28 |
| 3,806,951 | 4/1974 | Halteman | 2/6 |
| 3,825,952 | 7/1974 | Pershing et al. | 2/3 |
| 3,955,570 | 5/1976 | Hutter, III | 128/201.25 |
| 4,097,929 | 7/1978 | Lowe et al. | 2/10 |
| 4,136,688 | 1/1979 | German | 128/142 |
| 4,280,491 | 7/1981 | Berg et al. | 128/201 |
| 4,315,335 | 2/1982 | Kennedy, Jr. et al. | 2/424 |
| 4,573,217 | 3/1986 | Reed | 2/7 |
| 4,683,880 | 8/1987 | Werjefelt | 128/201.28 |
| 5,054,479 | 10/1991 | Yelland et al. | 128/201.25 |
| 5,104,430 | 4/1992 | Her-Mou | 55/385.1 |
| 5,125,402 | 6/1992 | Greenough | 128/201.25 |
| 5,533,500 | 7/1996 | Her-Mou | 128/201.25 |
| 5,575,278 | 11/1996 | Bonhomme et al. | 128/201.29 |
| 5,823,188 | 10/1998 | Harges, Jr. et al. | 128/206.19 |

FOREIGN PATENT DOCUMENTS

| | | | |
|---|---|---|---|
| 133568 | 7/1949 | Australia | 2/9 |
| 1 402 287 | 8/1975 | United Kingdom . | |
| 1 310 585 | 9/1997 | United Kingdom . | |

OTHER PUBLICATIONS

PCT Search Report mailed Nov. 30, 1998.

"Powered Respirators" *Racal Health & Safety*, 6 page brochure, 1993.

*Primary Examiner*—Aaron J. Lewis
*Assistant Examiner*—Joseph F. Weiss, Jr.
*Attorney, Agent, or Firm*—Michaele A. Hakamaki

[57] ABSTRACT

A face seal assembly for respirators comprising a generally U-shaped frame having a bottom portion and first and second side portions spaced from each other and extending in a generally upward direction from the bottom portion. The assembly further includes a first face seal segment attached to the bottom portion at a point closer to the second side portion than the first side portion and to the first side portion at a point above the bottom portion, and a second face seal segment attached to the bottom portion at a point closer to the first side portion than the second side portion and to the second side portion at a point above the bottom portion. The first and second face seal segments may each include an elastic piece. Further, at least a portion of the first face seal segment may extend beyond the elastic piece of the first face seal segment to form a first face seal flap and at least a portion of the second face seal segment may extend beyond the elastic piece of the second face seal segment to form a second face seal flap. The first and second face seal segments may be made of cloth, which may be nonwoven fabric, a woven fabric, a flame-retardant material, or an elastic material. The cloth of the first and second face seal segments may also be nonporous to prevent the movement of air through the cloth.

16 Claims, 6 Drawing Sheets

FACE SEAL FOR RESPIRATOR

TECHNICAL FIELD

The present invention relates to face seals for respirators and more particularly to face seals that seal the interface between a respirator and the face of a wearer to prevent contaminated air from entering the wearer's breathing zone.

BACKGROUND OF THE INVENTION

Respirators are commonly worn by people working in areas where the air may be contaminated with toxic or noxious substances such as airborne particulates, gases, and vapors. For example, the air in a sanding or grinding area may contain airborne dust particles, the air in a painting area may contain solvent vapors or droplets of paint, and the air in a welding area may contain fumes that would be harmful to inhale. People working in these areas will often wear a respirator that either filters contaminated air before it reaches the breathing zone of the wearer or supplies the user with uncontaminated air from a remote air source.

The type of respirator used in a particular environment depends on the amount and type of protection required by the wearer. When it is desirable to protect both the eyes and respiratory system of a wearer, a device commonly referred to as a "loose fitting face piece" is often used. The term "loose fitting face piece" defines a classification of the American National Standards Institute (ANSI) for a respiratory protective system in which a face shield or some type of enclosure about the face is designed to form a partial seal with the face. Loose fitting face pieces typically do not cover the neck and shoulders of the wearer and may include a helmet or other headpiece to protect the head from flying or falling objects. In many cases, a face shield is designed to rotate with respect to the headgear between a position covering the face and eyes and a position away from the face.

In order to help prevent contaminated air from reaching the face and eyes of the wearer, loose fitting face pieces are often provided with a face seal. When the respirator is sealed in this way, the air pressure inside the mask can be either negative or positive as compared to the surrounding environment. A negative pressure respirator is designed to have a lower pressure inside the mask than the surrounding ambient air and requires an air-tight seal between the mask and the face of the wearer to prevent contaminated air from being pulled into the respirator. A positive pressure respirator is designed to have a higher pressure inside the mask than the surrounding air and commonly has at least one small opening to allow excess air that is under pressure in the mask to escape into the surrounding ambient air.

There are several known face seal designs used with loose fitting face pieces. One common face seal design includes a piece of fabric having one edge attached to the sides and lower portion of a rigid face shield piece and having elastic material along the other edge. When a user pulls the rigid face shield piece down to a position covering the face, the elastic edge typically contacts the front of the user's chin and mouth area. For user comfort and in order to assist in forming a proper seal, the user must reach up under the face shield piece to pull the elastic edge of the fabric underneath the chin. This process may be difficult and inconvenient for the user, particularly if that person needs to use both hands for some other task, or if the person is wearing cumbersome work gloves.

This face seal design can also be inconvenient for users who wear glasses under the face shield, because the elastic edge of the fabric can interfere with the corner of the glasses when the face shield is being pulled down over the face. This contact between the elastic and glasses can dislocate the glasses or cause the glasses to fall from the user's face.

Another face seal design involves the use of a U-shaped flange made of rubber or other resilient material positioned on the inside of the face shield to contact the cheeks and chin of the wearer and provide a seal. For example, U.S. Pat. No. 4,280,491 (Berg et al.), which is commonly owned by the assignee of the present invention, describes a respirator having U-shaped sealing means formed of a resilient material, such as foam, fastened along the peripheral edge of a frame to seal the face shield assembly along the sides and across the chin of the user's face. While these face seals can provide an adequate seal for some users, the seals may not be easily adaptable to accommodate different face and head sizes. Thus, these face seals may not be interchangeable between users.

SUMMARY OF THE INVENTION

The present invention provides a face seal for use with respirators which self-adjusts to the face of the wearer when the face shield is lowered to its working position. Flexible face seal segments provide the correct positioning of the face seal for both comfort and respiratory protection of the wearer.

In one aspect of this invention a face seal assembly for respirators is provided, wherein the assembly comprises a generally U-shaped frame having a bottom portion and first and second side portions spaced from each other and extending in a generally upward direction from the bottom portion. The assembly further includes a first face seal segment attached to the bottom portion at a point closer to the second side portion than the first side portion and to the first side portion at a point above the bottom portion, and a second face seal segment attached to the bottom portion at a point closer to the first side portion than the second side portion and to the second side portion at a point above the bottom portion. The present invention also includes within its scope that the first face seal segment overlaps the second face seal segment and that the first and second face seal segments each include an elastic piece.

In this face seal assembly, at least a portion of the first face seal segment may extend beyond the elastic piece of the first face seal segment to form a first face seal flap and at least a portion of the second face seal segment may extend beyond the elastic piece of the second face seal segment to form a second face seal flap. In at least one embodiment, the first and second face seal segments are made of cloth, which may be nonwoven fabric, a woven fabric, a flame-retardant material, or an elastic material. The cloth of the first and second face seal segments may also be nonporous to prevent the movement of air through the cloth.

In another aspect of the present invention, a respirator is provided, wherein the respirator comprises a helmet, a face shield assembly comprising a face shield frame attached to the helmet and a face shield mounted therein, and a face seal assembly attached to the face shield assembly. In this aspect of the invention, the face seal assembly comprises a generally U-shaped face seal frame having a bottom portion and first and second side portions spaced from each other and extending in a generally upward direction from the bottom portion, a first face seal segment attached to the bottom portion at a point closer to the second side portion than the first side portion and to the first side portion at a point above the bottom portion, and a second face seal segment attached to the bottom portion at a point closer to the first side portion then the second side portion and to the second side portion at a point above the bottom portion. When the face shield assembly is positioned over the face of a wearer, the first face seal segment contacts a first side of the wearer's face, the second face seal segment contacts a second side of the wearer's face, and the first and second face seal segments cross under the wearer's chin, thereby generally sealing the wearer's face from air outside the respirator.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Figure 1:
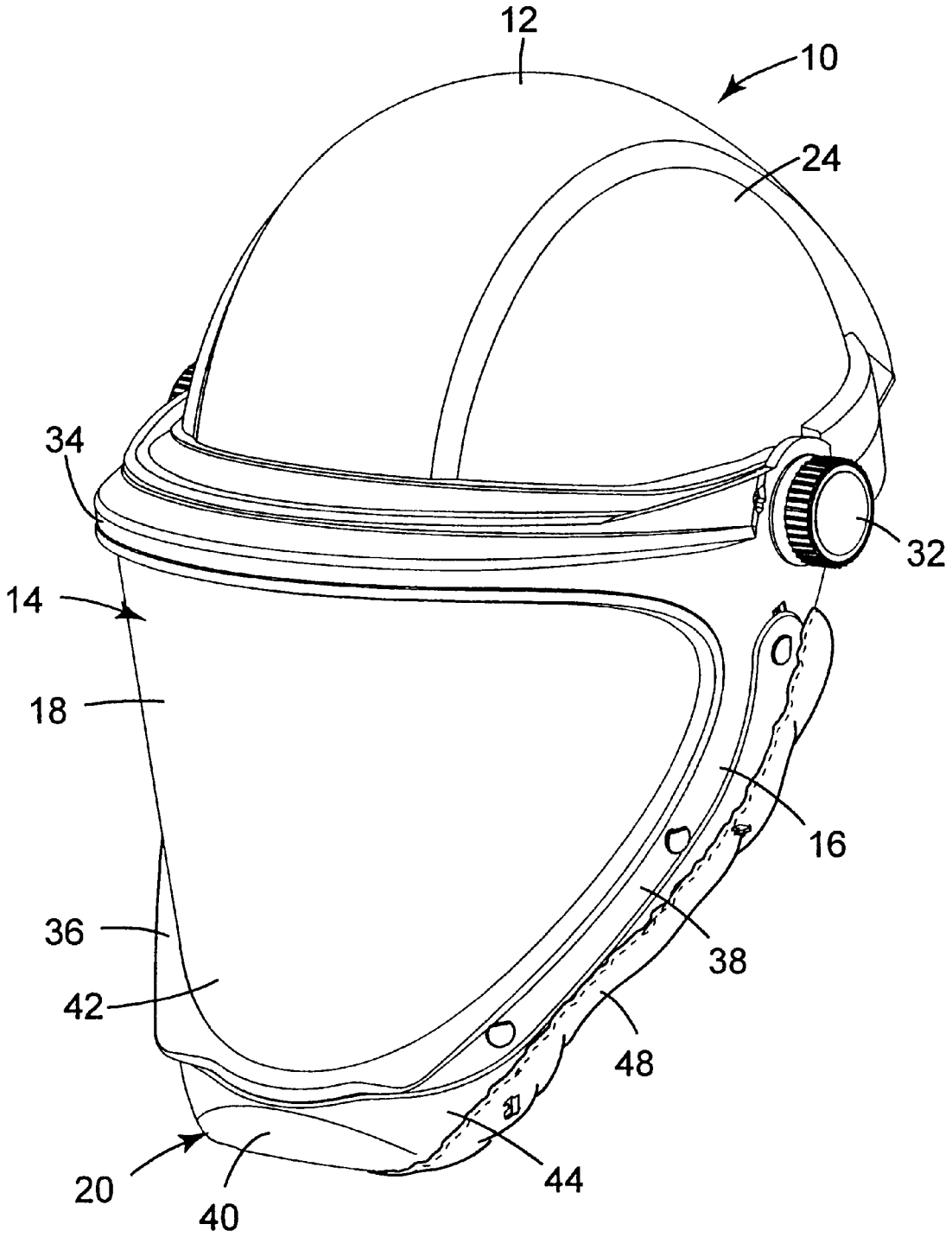
FIG. 1 is a perspective view of one embodiment of a respirator according to the present invention.
Figure 2:
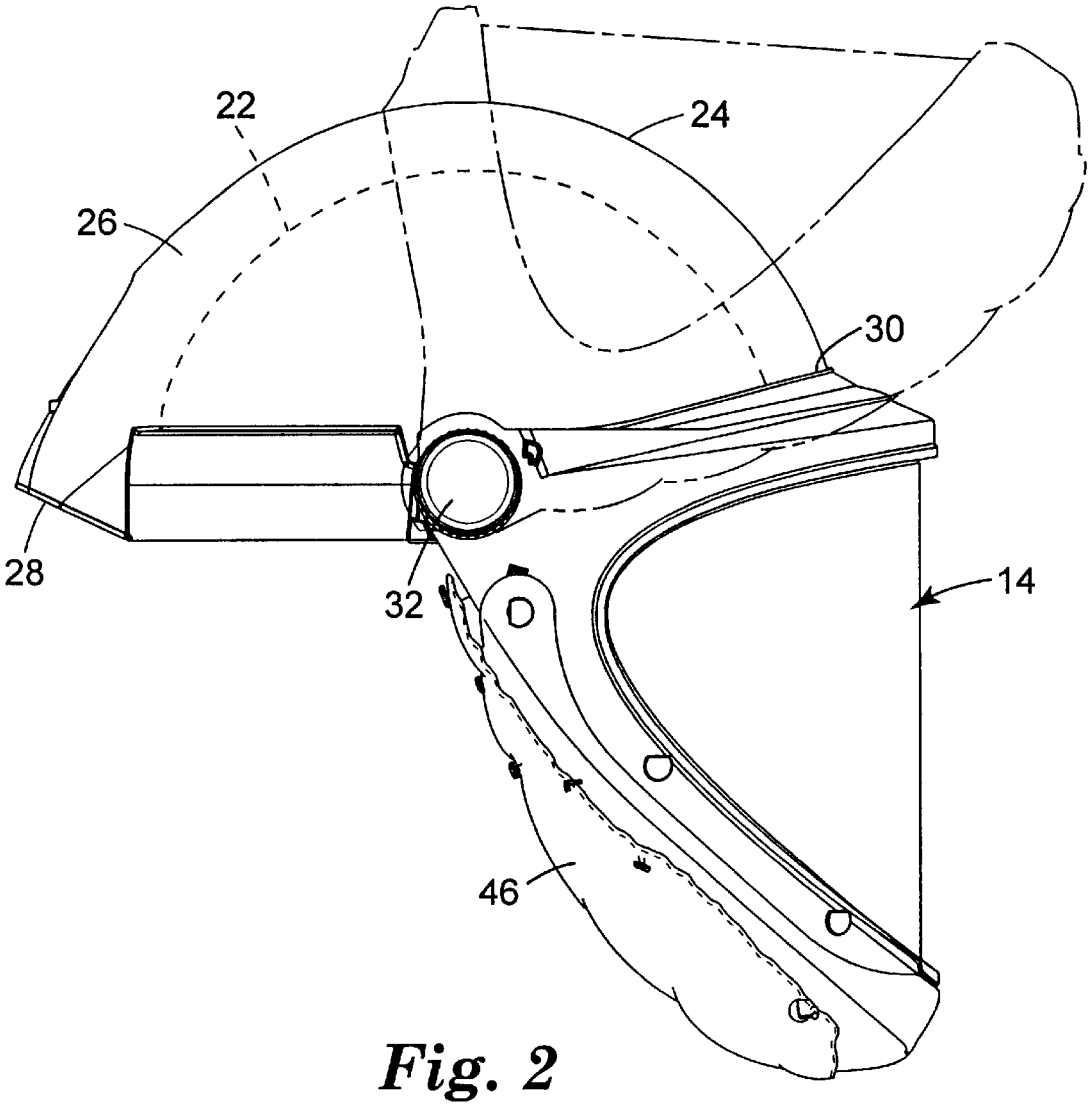
FIG. 2 is a side view of a respirator according to the present invention, showing a face shield assembly in its operational position and also showing the face shield assembly in its raised position in dotted lines.

Referring now to the Figures, wherein the components are labeled with like numerals throughout the several Figures, and initially to FIGS. 1 and 2, one preferred embodiment of a respirator or loose fitting face piece 10 is illustrated which basic components include a helmet or headpiece 12, a face shield assembly 14 rotatably attached to helmet 12, and a face sealing assembly 20. Helmet 12 is typically hemispherical in shape and comprises an inner shell 22 spaced from an outer shell 24, where a generally dome-shaped passageway or chamber 26 is defined between shells 22 and 24. In one preferred configuration, helmet 12 and chamber 26 further comprise a rear opening or receptacle 28 designed to accept an air supply hose (not shown), and a front opening 30 designed to allow the supplied air to escape into the face area and breathing zone of the wearer. When assembled, the outer shell 24 is superposed over the inner shell 22 and the periphery of these shells are typically sealed between the rear opening 28 and the front opening 30 to prevent undesirable leakage of air from the sides of the helmet. In operation, air is supplied under pressure to the rear opening 28. The air moves into the rear area of the chamber 26 nearest the rear opening 28 and toward the front area of the chamber 26. The air then exits the chamber 26 through the front opening 30 and into the breathing zone of the wearer. Examples of helmets having an air passageway or chamber are shown in U.S. Pat. Nos. 4,280,491 (Berg et al.) and 4,136,688 (Gorman). It will be appreciated by those skilled in the art that this description directed to loose fitting face pieces is descriptive and is not intended to be limited to loose fitting face pieces.

The face shield assembly 14 is preferably attached to the sides of the helmet 12 by a hinge assembly 32. As shown in FIG. 2, the hinge assembly 32 allows the wearer to rotate the face shield assembly 14 away from the face (illustrated in dotted lines and hereinafter referred to as the uppermost position). With continuing reference to FIGS. 1 and 2, the hinge assembly 32 also allows rotation of the face shield assembly 14 down over the face of the user when the respirator is in use (hereinafter referred to as the lowermost or working position). The hinge assembly 32 may be designed so that the face shield assembly 14 can be fixed at different positions between the uppermost and lowermost positions, or may be freely rotatable between these positions. It is known that the face shield may be rotatably attached to the helmet in various different ways, all of which are considered to be within the scope of this invention. It is further understood that the face shield assembly may be fixed so that it does not rotate with respect to the helmet. In this case, the hinge assembly 32 may be eliminated from the respirator.

One configuration of the face shield assembly 14 includes a face shield frame 16 as shown in FIG. 1. The frame 16 preferably comprises a top frame portion 34, two side frame portions 36, 38 spaced from each other, and a lower frame portion 40 connecting frame portions 36, 38. The top frame portion 34 preferably extends across the lower edge of the front of the helmet 12 when the face shield assembly 14 is in its lowermost position, and may be provided with a seal (not shown) between the top frame portion 34 and the helmet 12 to assist in preventing air from entering or escaping the breathing zone of respirator. Side frame portions 36, 38 extend from top frame portion 34 in a generally downward direction and away from the face of the wearer. Lower frame portion 40 connects the bottom edges of side frame portions 36, 38 and is generally parallel to the top frame portion 34. Thus, the frame 16 comprises a generally U-shaped lower portion including side frame portions 36, 38 extending from a lower frame portion 40. An opening 42 is provided between the portions of the frame 16, wherein the opening 42 is sufficiently large to provide the wearer with a substantially unobstructed forward and peripheral field of view. A generally transparent face shield 18 is positioned within the opening 42 to protect the face of the respirator wearer. The face shield 18 is preferably made of a tough, generally transparent flexible plastic material such as polycarbonate, cellulose, acetate, acrylic, polyester, or the like, and is designed to fit tightly within the face shield frame 16. As described above, when the face shield assembly 14 is in its lowermost position, the side frame portions 36 and 38 are spaced away from the sides of the user's face and the lower frame portion 40 is spaced away from the chin area of the user. It is understood that the face shield assembly 14 may be a welding shield, wherein the face shield frame 16 and the face shield 18 are manufactured from materials that are appropriate for use in welding environments.

In order to seal the areas between of the face shield assembly 14 and the face of the wearer, face shield assembly 14 is provided with a face seal assembly 20. In one preferred embodiment, illustrated in FIGS. 3 and 4, the face seal assembly 20 generally comprises a face seal frame 44 and two face seal segments 46, 48. More specifically, face seal frame 44 has a generally U-shaped configuration, including two side frame portions 50, 52 that extend in a generally upward direction from a bottom frame portion 54. The frame 44 may be designed to generally follow the shape and size of the face shield frame 16 so that the frame 44 can be tightly attached to the face shield assembly 14 with few or no openings for air leakage between the face shield frame 16 and the face seal frame 44. The frame 44 further comprises connectors 56 to attach the face seal frame 44 to the face shield frame 16 near the top portions of each of the side frame portions 50, 52. In this embodiment, the connectors 56 are illustrated as pins that extend from the side frame portions 50, 52, however, any conventional connection method is considered to be within the scope of this invention. Preferably, the connectors 56 allow for secure attachment of the face seal frame 44 to the face shield frame 16, while permitting easy removal of the frame 44 when desired.

Figure 3:
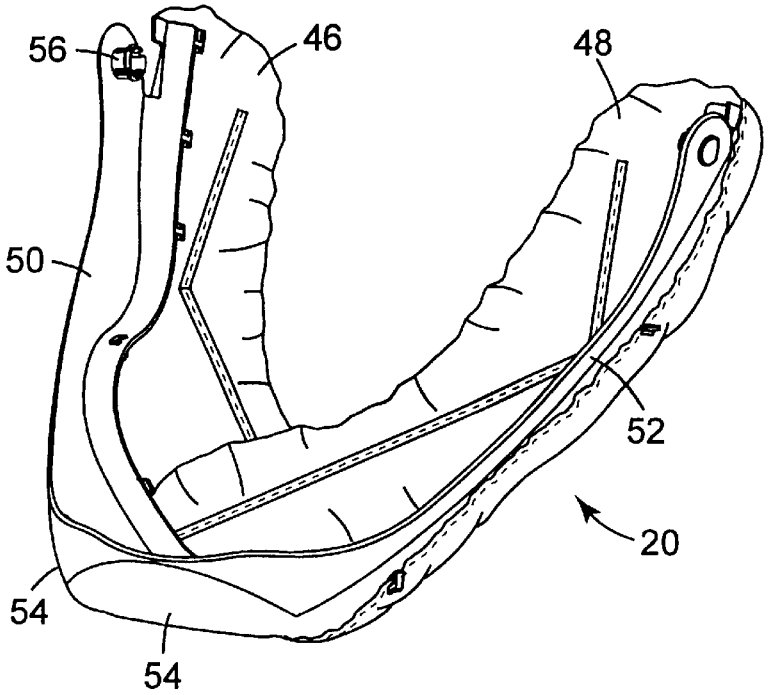
FIG. 3 is a perspective view of the face seal assembly of FIG. 1.

It is preferred that the face seal frame 44 be generally concave in cross section, as shown generally in FIG. 3. This cross-section advantageously provides additional space for the user's face to move from side to side within the respirator when face seal frame 44 is attached to face shield frame 16 and positioned in front of the user's face.

Figure 4:
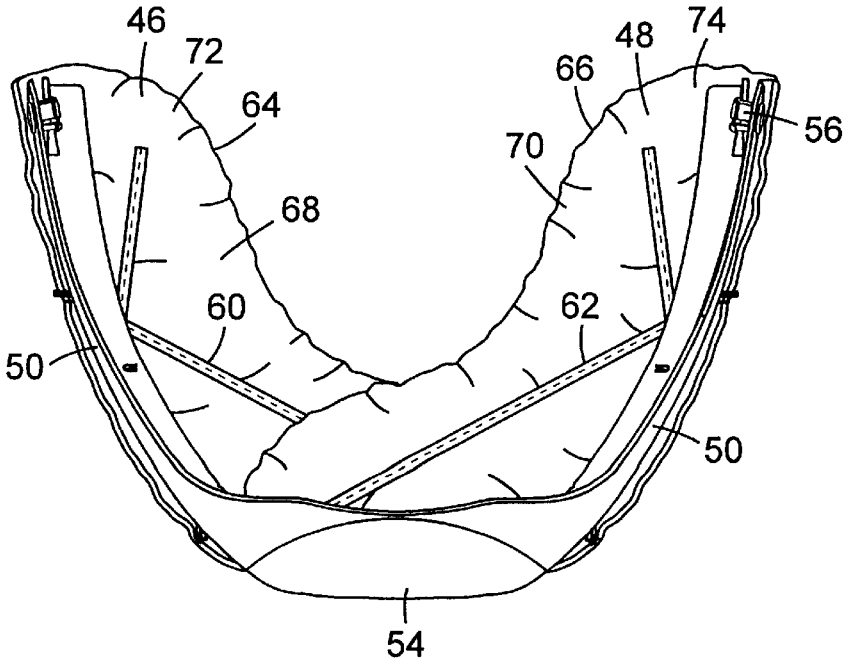
FIG. 4 is a front view of a face seal assembly including the face seal of the present invention.

FIGS. 3 and 4 also illustrate one arrangement of the face seal segments 46, 48 as positioned within face seal frame 44 before contacting a wearer's face or after removal from a wearer's face. In this arrangement, the first face seal segment 46 is preferably attached to an upper part of the side face seal frame portion 50 and to the bottom frame portion 54 at a point adjacent the opposite side face seal frame portion 52. Similarly, the second face seal segment 48 is preferably attached to an upper part of the side face seal frame portion 52 and to the bottom frame portion 54 at a point adjacent the side face seal frame portion 50. Thus, the points where each of the segments 46, 48 are attached to the bottom frame portion 54 are preferably spaced from each other. It is understood that the point on the side frame portions 50, 52 where the first and second face seal segments 46, 48 are attached can be any point above the point where each of these face seal segments are attached to bottom frame portion 54. It is preferable, however, that the point where each of the face seal segments 46, 48 is attached to the side frame portions 50, 52 is spaced as far as possible from the bottom frame portion 54, in order to span a greater portion of the frame 44 and thereby provide a larger amount of sealing protection. Thus, the face seal segments 46, 48 at least partially overlap each other to provide the face sealing capability of the present invention.

In accordance with the present invention and as best illustrated in FIG. 4, at least one strip of elastic material 60 is attached to the face seal segment 46 and at least one strip of elastic material 62 is attached the face seal segment 48. In the preferred embodiment, the face seal segments 46, 48 are a flexible material, such as cloth, and the elastic strips 60, 62 are sewn thereto. Elastic strips 60, 62 should be sufficiently elastic to allow separation of the face seal segments 46, 48 from each other, while providing a comfortable seal around the wearer's face. The elastic strips 60, 62 are preferably positioned on the face seal segments 46, 48 as shown in FIG. 4. That is, the elastic strip 60 is spaced from an edge 64 of the face seal segment 46 so that a loose portion or flap 68 extends between the elastic strip 60 and the edge 64. Similarly, the elastic strip 62 is spaced from an edge 66 of the face seal segment 48 so that a loose portion or flap 70 extends between the elastic strip 62 and the edge 66. The desirability of these flaps 68, 70 will be described below.

Figure 5:
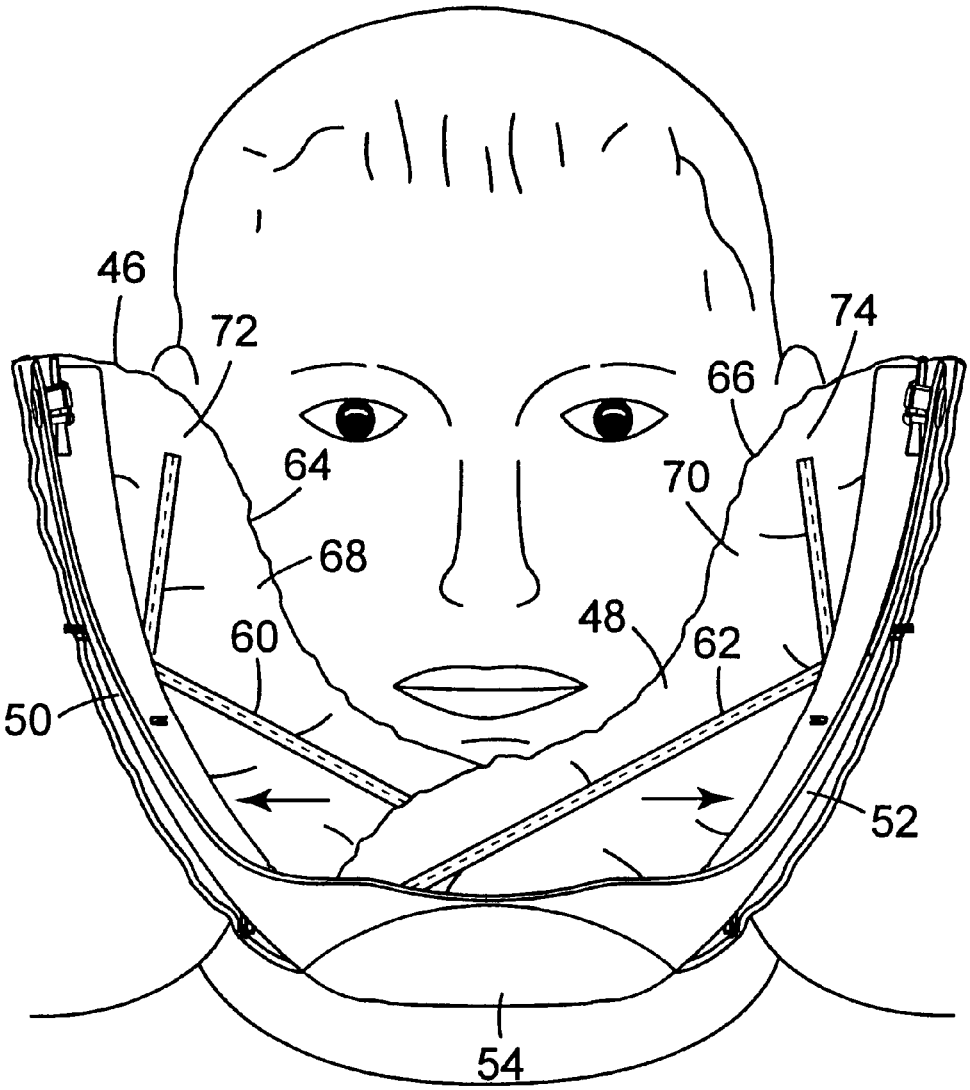
FIG. 5 is a front view of the face seal assembly of FIG. 4, incorporating the face seal of the present invention with the partial insertion of a human head.

FIG. 5 shows the separation of face seal segments 46, 48 of FIG. 4 when a wearer's face initially contacts the face seal segments. In operation, this occurs when the wearer rotates the face shield assembly 14 down toward its working position. Alternatively, it is understood that the face shield assembly 14 may already be in its lowermost or working position when the wearer initially places the helmet 12 on his or her head. As shown in FIG. 5, the face seal segment 46, which is closer to the wearer's face, first contacts the face of the wearer and is pushed by the face toward the side frame portion 50. Similarly, the face seal segment 48, which is in overlapped relation to face seal segment 46, is pushed toward the side frame portion 52. In accordance with the invention, the face seal segments 46 and 48 are not attached to each other where they cross or overlap so that they can easily separate the necessary distance as the face shield is moved toward the working position and the face contacts these segments. Thus, the face seal assembly 20 can accommodate various face shapes and sizes without adjusting the face seal segments.

Figure 6:
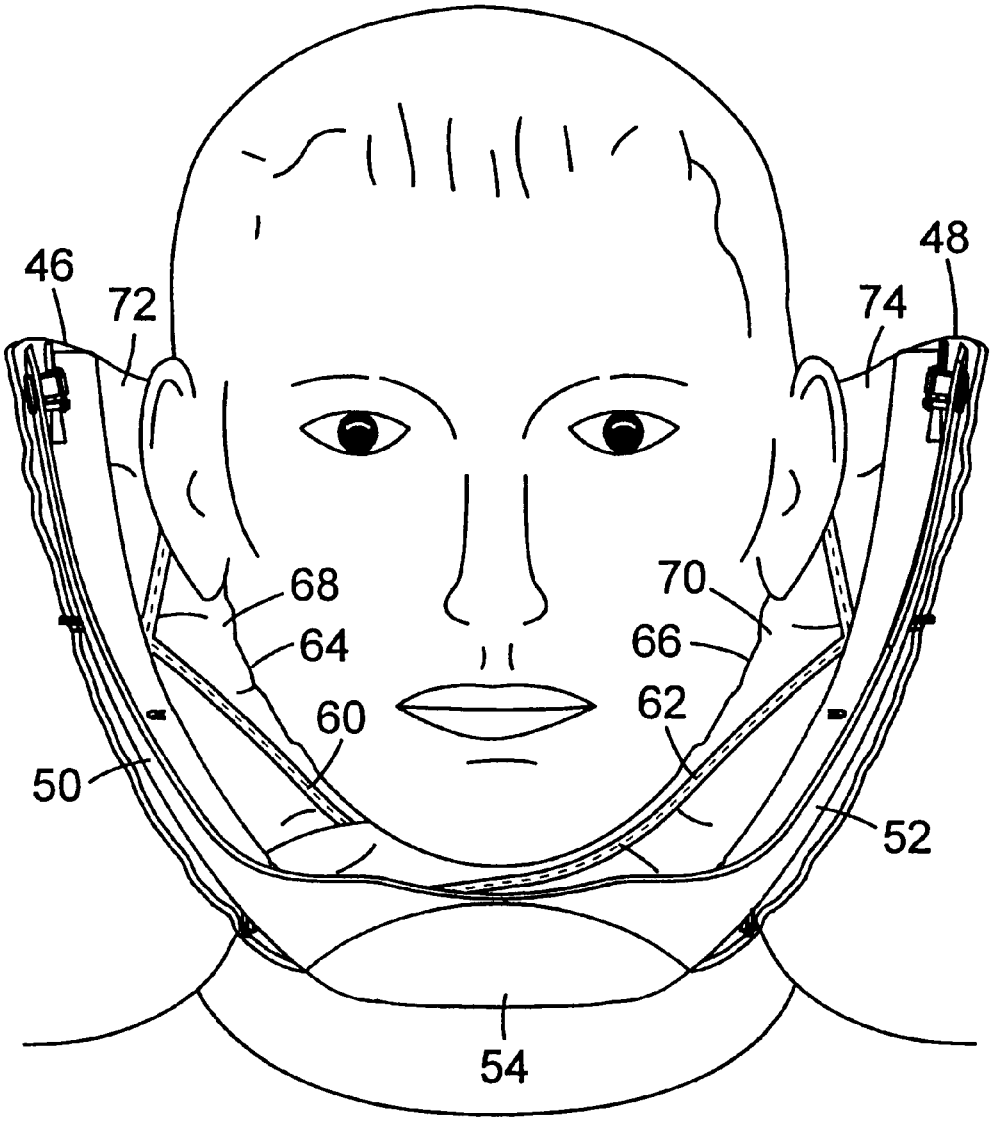
FIG. 6 is a front view of the face seal assembly of FIGS. 4 and 5, incorporating the face seal of the present invention with the human head inserted further than in FIG. 5.

FIG. 6 illustrates the face seal segments 46, 48 as they seal around the wearer's face when the face shield assembly 14 is in its working or lowermost position. This position is similar to that described above with respect to FIG. 5, except that the face seal segments 46, 48 are further pushed toward the side face seal frame portions 50, 52 and side face shield frame portions 36 and 38 (not shown in this figure), respectively. In most cases, the elastic portions 60, 62 are stretched by the insertion of the wearer's face between segments 46, 48, which helps to form the proper seal for operation of the respirator. Further, it is preferred that the flap portions 68, 70 extend onto the face of the wearer to better seal against air filtration into the wearer's breathing zone. In other words, when the face shield assembly 14 is positioned over the face of a wearer, the first face seal segment 46 contacts the first side of the wearer's face, the second face seal segment 48 contacts the second side of the wearer's face, and the first and second face seal segments 46, 48 cross under the wearer's chin, thereby generally sealing the wearer's face from air outside the respirator. The flaps 68, 70 are desirable to form an additional barrier to the entrance of contaminants, particularly for wearers with smaller face sizes.

In the preferred embodiment, the face seal segments 46, 48 are made of a flexible material to allow the face seal to function as described above. The actual material chosen for the segments 46, 48 may vary widely, where different properties may be desirable for different respirator applications. For example, the material should be sufficiently flexible to allow the face seal segments 46, 48 to separate from each other, but should also be sufficiently stiff so that the flap portions 68, 70 can rest against the wearer's face without falling away from the face. The material selected can be a woven fabric or a nonwoven material. It is often desirable that the material also be nonporous to prevent air outside the respirator to move through the material and into the breathing zone of the respirator. The material may also be washable so that the face seal segments may be reusable after washing. It may further be desirable that the material is fire-retardant, particularly when the respirator will be used in environments such as welding applications. One example of a preferred material that is relatively comfortable, lightweight, nonporous, and fire-retardant is fabric commercially available from the DuPont Corporation of Willmington, Del., under the trade designation "Sontara®."

Alternatively, the face seal segments 46, 48 may be made of an elastic material, such as rubber. In this case, the elastic in the material may provide the necessary elasticity for proper functioning of the face seal segments and the elastic pieces 60, 62 may therefore be unnecessary.

The face seal segments 46, 48 may be attached to the face seal frame 44 by various attachment means. The attachment means chosen may allow the face seal segments to be easily removed from the face seal frame for replacement with new face seal segments. For example, the face seal segments may be provided with holes near their outer edges to match with pegs or protrusions from the face seal frame so that the holes can be placed over the protrusions for attachment thereto (not shown). For another example, the edge of the face seal segments 46, 48 closest to their respective side frame portions 50, 52 may include an elastic portion to hold these segments against the frame portions. Alternatively, the face seal segments may be attached to the face seal frame by more permanent methods, such as applying an adhesive between the face seal frame and the outer edges of the face seal segments.

In some cases, it may be desirable for the face seal segments 46, 48 to be shaped so that there is a flexible portion that extends above the elastic strips 60, 62, hereinafter referred to as temple portions 72, 74. These temple portions 72, 74 are attached to the upper portion of the side face seal frame portions 50, 52, respectively, to seal against the upper part of the face (i.e., near the temples of the wearer) when the face shield assembly is in the working position. These temple portions advantageously provide sealing of wearer's upper face area, while allowing the wearer to move face shield assembly 14 from its uppermost position to its working position without substantial interference between face seal segments 46, 48 and the face or glasses of the wearer. In operation, the temple portions 72, 74 should be sufficiently free from the face seal frame 44 so that they can move away from the wearer's face when the face shield assembly 14 is lowered. At least some part of each of the temple portions 72, 74 may also be reinforced with another piece of material or the like (not shown) in order to provide additional sealing capabilities in the upper area of the wearer's face.

Figure 7:
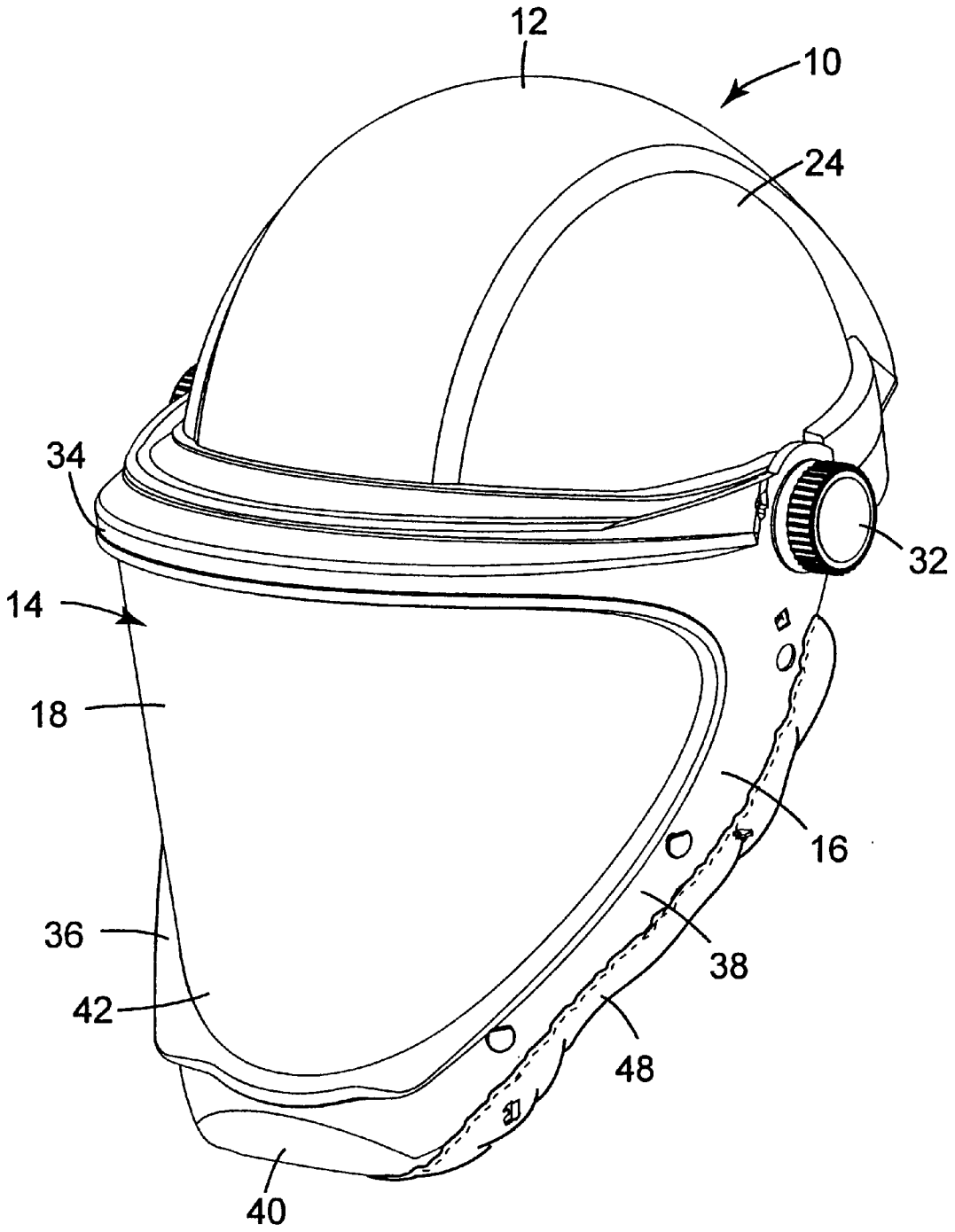
FIG. 7 is a perspective view of another embodiment of a respirator according to the present invention.

While the embodiment of FIG. 1 shows face seal segments attached to a separate face seal frame that is attached to a face shield frame, it is also contemplated that these segments instead be attached directly to the face shield frame. FIG. 7 illustrates this embodiment of the face shield assembly 14, where face seal segments 46 and 48 are attached directly the face shield frame 16. More specifically, the face seal segment 46 is attached to the upper part of the side frame portion 36 and to the lower frame portion 40 adjacent the opposite side frame portion 38. The face seal segment 48 is attached to the upper part of the side frame portion 38 and to the lower frame portion 40 adjacent the opposite side frame portion 36. In all other respects, it is desirable that the face seal assembly have the characteristics of the face seal assembly described above with respect to FIGS. 1 through 6.

It is also within the scope of this invention that the face seal segments are attached to the outer edge of a lens that does not have a separate frame (not shown). In this case, the respirator does not have the type of face shield frame described above. Instead, the lens is attached to an air supply device and the outer edge of the lens is actually the frame that supports the face seal segments in the configuration of the present invention.

The respirator 10 may be a powered air respirator, such as a self-contained battery powered unit, where the respirator may be provided with a filter (not shown) to filter incoming contaminated air before it reaches the breathing zone of the wearer. Alternatively, the respirator 10 may be a supplied air respirator, where the supplied air is prefiltered so that no additional air filters may be necessary. In addition, while the face seals described above are primarily designed for use with a positive pressure respirator, it is also contemplated that the face seal may be used for different respirator classifications.

The present invention has now been described with reference to several embodiments thereof. The foregoing detailed description has been given for clarity of understanding only. No unnecessary limitations are to be understood therefrom. It will be apparent to those skilled in the art that many changes can be made in the embodiments described without departing from the scope of the invention. For instance, devices such as medical masks are also contemplated. Thus, the scope of the present invention should not be limited to the structures described herein, but only by the structures described by the language of the claims and the equivalents of those structures.

We claim:

1. A face seal assembly for respirators comprising:

a generally U-shaped frame comprising a bottom portion and first and second side portions spaced from each other and extending in a generally upward direction from the bottom portion;

a first face seal segment attached to the bottom portion at a point closer to the second side portion than the first side portion and to the first side portion at a point above the bottom portion; and a second face seal segment attached to the bottom portion at a point closer to the first side portion than the second side portion and to the second side portion at a point above the bottom portion.

2. The face seal assembly of claim 1, wherein the first face seal segment overlaps the second face seal segment.

3. The face seal assembly of claim 1, wherein the first and second face seal segments each include an elastic piece.

4. The face seal assembly of claim 3, wherein at least a portion of the first face seal segment extends beyond the elastic piece of the first face seal segment to form a first face seal flap and at least a portion of the second face seal segment extends beyond the elastic piece of the second face seal segment to form a second face seal flap.

5. The face seal assembly of claim 1, wherein the first and second face seal segments are made of a flexible fabric.

6. The face seal assembly of claim 5, wherein the flexible fabric of the first and second face seal segments is a nonwoven fabric.

7. The face seal assembly of claim 5, wherein the flexible fabric of the first and second face seal segments is a woven fabric.

8. The face seal assembly of claim 5, wherein the flexible fabric of the first and second face seal segments is flame-retardant.

9. The face seal assembly of claim 5, wherein the flexible fabric of the first and second face seal segments is nonporous to prevent the movement of air through the fabric.

10. The face seal assembly of claim 1, wherein the first and second face seal segments are made of an elastic material.

11. The face seal assembly of claim 1, wherein at least a portion of the frame is concave.

12. The face seal assembly of claim 1, wherein the frame comprises a face seal frame portion removably attached to a face shield frame portion.

13. A respirator comprising:

a helmet;

a face shield assembly comprising a face shield frame attached to the helmet, and a face shield mounted in the face shield frame; and a face seal assembly attached to the face shield assembly and comprising:

a generally U-shaped face seal frame comprising a bottom portion and first and second side portions spaced from each other and extending in a generally upward direction from the bottom portion;

a first face seal segment attached to the bottom portion at a point closer to the second side portion than the first side portion and to the first side portion at a point above the bottom portion; and a second face seal segment attached to the bottom portion at a point closer to the first side portion than the second side portion and to the second side portion at a point above the bottom portion;

wherein, when the face shield assembly is positioned over the face of a wearer, the first face seal segment contacts a first side of the wearer's face, the second face seal segment contacts a second side of the wearer's face, and the first and second face seal segments cross under the wearer's chin, thereby generally sealing the wearer's face from air outside the respirator.

14. The respirator of claim 13, wherein the face seal frame is releasably attached to the face shield frame.

15. The respirator of claim 13, wherein the first face seal segment further comprises an elastic piece, wherein the second face seal segment further comprises an elastic piece, and wherein at least a portion of the first face seal segment extends beyond the elastic piece of the first face seal segment to form a first face seal flap and at least a portion of the second face seal segment extends beyond the elastic piece of the second face seal segment to form a second face seal flap.

16. A respirator comprising:

a helmet;

a face shield assembly comprising a face shield frame attached to the helmet and a face shield mounted in the face shield frame; and a face seal assembly comprising:

a face seal frame attached to the face shield frame and comprising a bottom portion and first and second side portions spaced from each other and extending from the bottom portion;

a first face seal segment attached to the first side portion at a point above the bottom portion and to the bottom portion adjacent the second side portion, wherein the first face seal segment comprises at least one elastic portion; and a second face seal segment attached to the second side portion at a point above the bottom portion and to the bottom portion adjacent the first side portion, wherein the second face seal segment comprises at least one elastic portion;

wherein the first face seal segment at least partially overlaps the second face seal segment, and wherein the elastic portion of the first face seal segment is not attached to the elastic portion of the second face seal segment.

* * * * *

UNITED STATES PATENT AND TRADEMARK OFFICE

CERTIFICATE OF CORRECTION

PATENT NO. : 6,016,805
DATED : January 25, 2000
INVENTOR(S) : James A. Burns and Gerald M. Brostrom It is certified that error appears in the above-identified patent and that said Letters Patent is hereby corrected as shown below:

Title page,
Item [56], FOREIGN PATENT DOCUMENTS section, "1 310 585" should read -- 2 310 585 --.

Signed and Sealed this

Second Day of October, 2001

*Attest:*

Nicholas P. Godici

*Attesting Officer*

NICHOLAS P. GODICI
*Acting Director of the United States Patent and Trademark Office*